United States Patent [19]

Morimoto et al.

[11] 4,448,614

[45] May 15, 1984

[54] PROCESS FOR COOLING A COLD ROLLED STEEL STRIP

[75] Inventors: Masao Morimoto, Yokohama; Ichiro Shimbashi, Kitakyushu; Hiroshi Iida, Himeji; Koichi Sakurai, Kitakyushu, all of Japan

[73] Assignee: Nippon Steel Corporation, Japan

[21] Appl. No.: 249,904

[22] Filed: Apr. 1, 1981

[30] Foreign Application Priority Data

Oct. 9, 1980 [JP] Japan ..... 55-141311

[51] Int. Cl.[3] ..... C21D 9/52

[52] U.S. Cl. ..... 148/12.1; 148/12.3; 148/16.7; 148/156; 148/157

[58] Field of Search ..... 148/153, 156, 157, 142, 148/12.1, 12.3, 12.4, 16, 16.7

[56] References Cited

U.S. PATENT DOCUMENTS 3,208,742 9/1965 Peretick ..... 266/121
4,329,188 5/1982 Wang ..... 148/153

FOREIGN PATENT DOCUMENTS 2165049 7/1972 Fed. Rep. of Germany .

*Primary Examiner*—R. Dean
*Attorney, Agent, or Firm*—Wenderoth, Lind & Ponack

[57] ABSTRACT

A cold rolled steel strip having an elevated temperature is continuously cooled to a desired temperature at a desired cooling rate by a process comprising moving the cold rolled steel strip along at least one vertical cooling path, and; bringing a plurality of streams each consisting of a mixture of a cooling gas and a cooling liquid into contact with each surface of the steel strip, each mixture stream being prepared by jetting the cooling gas and liquid independently from others in directions intersecting each other before the vertical path of the steel strip.

5 Claims, 10 Drawing Figures

PROCESS FOR COOLING A COLD ROLLED STEEL STRIP

FIELD OF THE INVENTION

The present invention relates to a process and an apparatus for continuously cooling a cold rolled steel strip having an elevated temperature. More particularly, the present invention relates to a process and apparatus for continuously cooling a cold rolled steel strip which has been just annealed at an elevated temperature and which may be an ordinary cold rolled steel sheet or a high tensile strength steel strip.

BACKGROUND OF THE INVENTION

In a conventional batch type annealing process for producing a cold rolled steel strip useful for usual drawing processes, a cold rolled steel strip is coiled tightly or loosely, and the coil is placed in a box-shaped furnace and annealed therein at a desired temperature. However, this conventional batch type annealing process needs several days to complete the entire process thereof. That is, the efficiency of the process is very poor. In order to eliminate the above-mentioned disadvantage of the batch type annealing process, various continuous annealing processes which can be completed within about ten minutes, were attempted. Some of them are practically utilized in industry.

The conventional continuous annealing process are more advantageous than the conventional batch type annealing process in the following points.

1. The cost of the annealing apparatus is remarkably low.

2. The production cost is low, because the process can be effected by a reduced number of operations with a reduced consumption of energy at an enhanced yield.

3. The quality in appearance and surface quality, for example, flatness or shape, of the resultant product is superior.

4. The production can be completed at a high speed and the product can be quickly delivered.

Therefore, the continuous annealing processes are becoming an important area of investment in the steel-making industry.

However, in order to enhance the efficiency of the investment, it is required that the continuous annealing apparatus can exhibit an enhanced capacity and is capable of being applied to the production of not only the mild steel sheet (usable for the drawing process) but also, the high strength steel strip. Demand for a high tensile strength steel strip has recently been increasing. In order to satisfy the above-mentioned requirements, the conventional continuous annealing process and apparatus must be free from several problems. The problems will be explained below.

In a conventional continuous annealing process, the cold rolled steel strip which has been heated to a predetermined annealing temperature and, then, held at the annealing temperature for a predetermined time period, is usually cooled to a predetermined temperature by jetting an inert cooling gas toward the steel strip. The cooling gas jetting method exhibits the following advantages.

1. It is easy to stop the cooling procedure when the steel strip reaches a predetermined decreased temperature, for example, a predetermined overaging temperature. Therefore, when the cooled steel strip is subjected to an overaging procedure, it is unnecessary to heat the steel strip to the overaging temperature.

2. Since the cooling procedure is carried out by using an inert cooling gas, the surface of the steel strip is not oxidized, so as to maintain a bright surface. Therefore, it is not necessary to subject the cooled steel strip to a removal procedure of an oxide layer from the steel strip.

3. The cooling procedure does not cause the steel strip to be deformed. Therefore, the resultant cooled steel strip always has a satisfactory shape.

However, the cooling gas jetting method causes the cooling rate on the steel strip to be low, for example, 10° C./sec. or less. Therefore, the steel sheet must be overaged over a long period of time, and the annealing equipment including the cooling and overaging apparatus must be very long which is expensive. Also, in the case where a high tensile strength steel strip having a dual-phase structure is annealed and cooled by the cooling gas jetting method, it is necessary that the steel strip is produced from a steel material containing a relatively large amount of an expensive alloy element, for example, manganese. In this case, the resultant product becomes expensive.

In another conventional continuous annealing process, the cold rolled steel strip which has been held at a predetermined annealing temperature for a predetermined time period, is cooled by immersing the steel strip into water, that is, a water-quenching method. In this method, since the cooling water is directly brought into contact with the steel strip, the cooling rate of the steel strip is high, for example, $10^{3}$° C./sec. or more. This rapid cooling causes precipitation of oversaturated solid-soluted carbon in the steel sheet to be accelerated. However, since the cooling rate is too high, the temperature of the steel sheet rapidly reaches the same level of the cooling water. Therefore, it is difficult to stop the cooling procedure while the temperature of the steel sheet is still higher than that of the cooling water. When the annealed steel sheet is cooled to the same temperature as that of the cooling water, it is necessary to re-heat the steel sheet to a desired overaging temperature. This heating cost causes the price of the resultant product to be increased.

The same disadvantages as those of the steel sheet occur on the high tensile strength steel strip having a dual phase-structure. That is, when the high tensile strength steel strip is annealed and then, cooled by immersing it in cooling water, the excessively high cooling rate of the steel strip results in such an undesirable phenomenon that the solid-soluted carbon in the steel strip is quenched. Therefore, it is necessary to re-heat the cooled steel strip to the desired overaging temperature, for example, about 250° C. This re-heating procedure causes the cost of producing the high tensile strength steel strip to be increased. When the cold rolled steel sheet or high tensile strength steel strip is re-heated to the overaging temperature, the solid-soluted carbon precipitates in the form of carbides into the ferrite crystal grains. This phenomenon causes the ductility of the product to be degraded, and, therefore, the product to become useless. Also, the necessity of the re-heating procedure causes the necessity of addition of a re-heating apparatus which is very expensive to the annealing-overaging equipment. Therefore, the annealing-overaging processing time becomes long and the annealing-overaging equipment becomes costly.

In another cooling method, the annealing steel strip is directly immersed in a molten salt bath. In this method, since the melted salt has a great cooling capacity, it is possible to rapidly cool the steel strip to a desired temperature by maintaining the temperature of the melted salt at a desired temperature. However, this method is disadvantageous in that the cooling rate is not variable over the cooling procedure. That is, it is impossible to gradually cool the steel strip in the initial stage of the cooling procedure and, then, rapidly cool it in the final stage of the cooling procedure. This disadvantage sometimes causes the cooled steel strip to be deformed. Also, the melted salt method is disadvantageous such that when a portion of the melted salt adheres to the surface of the steel strip, the adhered portion of the melted salt is transferred onto surfaces of rollers in an overaging apparatus and accumulates thereon. The accumulated salt on the overaging rollers causes the quality of the resultant overaged steel strip to be degraded. Also, it is difficult to remove the adhered salt from the strip surface.

In another cooling method, streams of a cooling liquid were sprayed onto the surface of the steel strip. When the cooling liquid used has a great cooling capacity and the flow rate of the cooling liquid to be jetted is controlled, it is possible to rapidly cool the steel strip down to a desired temperature at a desired cooling rate. However, in the cooling liquid-spraying procedure, when the flow rate of the cooling liquid is decreased, sometimes, the streams of the sprayed cooling liquid cannot reach the surface of the steel strip. In this case, the steel strip is not cooled, but deformed.

In still another cooling method, a mixture of a cooling gas and an atomized cooling liquid is jetted onto the surface of the steel strip through a jetting nozzle. This method is valuable and disclosed in Japanese Patent Application Publication No. 53-15803(1978). In this method, the atomized cooling liquid having a relatively large cooling capacity is carried by the cooling gas stream having a relatively small cooling capacity. Therefore, it is possible to vary the cooling capacity of the cooling liquid-gas mixture stream by varying the amount of the cooling liquid to be contained in the mixture. That is, it is possible to vary the cooling rate of the steel strip by controlling the amount of the cooling liquid.

However, when the atomized cooling liquid is preliminarily mixed with the cooling gas and then, the resultant cooling liquid-gas mixture is jetted through a jetting nozzle, the fine particles of atomized cooling liquid are aggregated together to form large drops of the liquid in the mixture before the mixture reaches the surface of the steel strip. In this case, it is difficult to uniformly cool the steel strip at a high cooling rate.

SUMMARY OF THE INVENTION

An object of the present invention is to provide a process and apparatus for cooling a cold rolled steel strip having an elevated temperature, which process and apparatus are capable of rapidly cooling a steel strip at a cooling rate in the range of $10^2$° C./sec.

Another object of the present invention is to provide a process and apparatus for cooling a cold rolled steel strip having an elevated temperature, which process and apparatus are capable of easily stopping the cooling procedure thereof when the steel strip reaches a desired temperature. Still another object of the present invention is to provide a process and apparatus for cooling a cold rolled steel strip having an elevated temperature, which process and apparatus are capable of easily varying the cooling rate for the steel strip in a wide range and in accordance with a predetermined cooling program.

A further object of the present invention is to provide a process and apparatus for cooling a cold rolled steel strip having an elevated temperature, which process and apparatus do not cause the steel strip to be deformed even when the cooling procedure for the steel strip is carried out rapidly.

Another object of the present invention is to provide a process and apparatus for cooling a cold rolled steel strip having an elevated temperature, which process and apparatus are effective for producing a product which has a bright surface or the surface of which can be easily brightened by a simple and easy surface-treating procedure, the bright surface being necessary for the cold rolled steel strip.

The above-mentioned objects can be attained by the process of the present invention which comprises the steps of:

passing a cold rolled steel strip having an elevated temperature along at least one vertical cooling pass and;

bringing a plurality of streams each consisting of a mixture of a cooling gas with a cooling liquid into contact with each surface of the steel strip located in the vertical cooling passage in order to cool the steel strip to a predetermined temperature at a predetermined cooling rate, and which process is characterized in that each cooling gas-liquid stream is prepared by jetting the cooling gas and the cooling liquid independently from each other in directions intersecting each other before the jetted cooling gas and liquid streams reach the surface of the steel strip.

More specifically, there is provided a process for continuously cooling a cold-rolled steel strip which has been annealed in an inert gas atmosphere at an elevated temperature, which process comprises the steps of:

(a) moving a cold-rolled steel strip vertically downward along at least one cooling path, (b) bringing a plurality of streams, each stream consisting of a cooling gas and a cooling liquid comprising water, respectively, into contact with each surface of said steel strip in order to cool said steel strip to a predetermined temperature at a predetermined cooling rate, each stream being jetted independently from each other, and in which process, (i) said cooling gas consisting of a cooled inert gas extracted from said annealing process, (ii) said cooling gas and cooling liquid streams being jetted in directions intersecting each other before the jetted colling gas and liquid streams reach the surface of said steel strip, thus providing a plurality of cooling gas-liquid mixture streams, (iii) said cooling gas and said cooling liquid being mixed with each other in a volume ratio which is in the range of from 100:0.1 to 5,000:1 under atmospheric pressure, (c) removing the cooling liquid remaining on said steel strip surface from said surface when the temperature of said steel strip has reached the desired final temperature, and (d) moving said cooled strip into a vertically upward drying path to dry said steel strip.

Also, the afore-mentioned objects can be attained by the apparatus of the present invention which comprises, (A) a cooling chamber being provided with,
(a) an entrance thereof,
(b) an exit thereof, and
(c) at least one vertical cooling passage formed between said entrance and exit, along which entrance, passage and exit a cold rolled steel strip passes, and;

(B) a plurality of cooling chambers each located around said vertical cooling passage and each being provided with at least one means for jetting a stream consisting of a mixture of a cooling gas and a cooling liquid toward a surface of said steel strip passing along the vertical cooling passage, which apparatus is characterized in that each cooling gas-liquid mixture jetting means comprises a nozzle for jetting a cooling gas, connected to a cooling gas supply source through a supply line, and a separate nozzle for jetting a cooling liquid, connected to a cooling liquid supply source through a supply line, both said nozzles being directed to the path of said steel strip and the direction of said cooling gas nozzle intersecting the direction of said cooling liquid nozzle at a location nearer from said nozzles than the path of said steel strip.

DETAILED DESCRIPTION OF THE INVENTION

Figure 1:
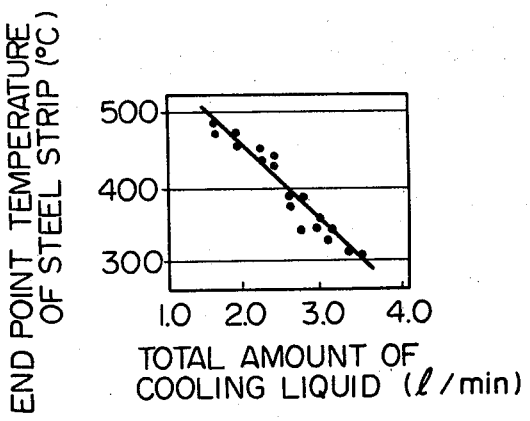
FIG. 1 is a graph showing a relationship between the total amount of a cooling liquid jetted onto a steel strip passing along a vertical cooling passage and a final (end point) temperature of the steel strip when it has reached the end of the passage.

Generally speaking, it is preferably that the continuous annealing process including a cooling procedure for an annealed cold rolled steel strip, satisfies the following items.

1. It is possible to rapidly cool the annealed steel strip at a cooling rate of at least about $10^{2}$° C./sec.
2. It is possible to easily control the final (end point) temperature of the cooled steel strip.
3. It is possible to alter the cooling rate of the steel strip in a broad range in accordance with a desired pattern of a cooling program.
4. The of shape the cooled steel strip can be maintained in good condition, even after a rapid cooling procedure.
5. Even if the cooling procedure causes the brilliance of the surface of the steel strip to be degraded, it is possible to make the steel strip surface brilliant by applying a simple and easy surface treatment to the steel sheet.

With respect to the rapid cooling procedure, it is known that when a steel strip is cooled with a cooling gas-liquid mixture, the relationship between the cooling rate of the steel strip and the heat-transfer coefficient of the cooling gas-liquid mixture is formulated by the equation (1):

$$CR = K \cdot \alpha / t \qquad (1)$$

wherein CR represents a cooling rate (° C./sec.) of the steel strip, o represents a heat transfer coefficient (k cal/m·h·°C.) of the cooling gas-liquid mixture, t represents a thickness (mm) of the steel strip and K represents a constant. Generally, the heat transfer coefficient of a cooling liquid having a very large specific heat is extreamly larger than that of a cooling gas having a small specific heat. Therefore, the heat transfer coefficient of the cooling gas-liquid mixture is mainly dominated by the specific heat of the cooling liquid.

In order to obtain a high strength steel strip having a dual phase structure and a thickness of 0.7 mm, it is necessary to rapidly cool the steel strip at a cooling rate of about 200° C./sec. after the annealing procedure. In order to obtain the above-mentioned cooling rate, it is necessary that the cooling gas-liquid mixture exhibits a heat transfer coefficient ($\alpha$) of about 1000 k cal/$m^2$·h·°C. In order to obtain the above-mentioned large heat-transfer coefficient, it is necessary to use a cooling liquid having a very large specific heat. That is, it is preferable that the cooling liquid comprises water. Also, it is not desirable to use ethyl alcohol, which is used as a cooling liquid in the process disclosed in Japanese Patent Application Publication No. 53-15803, because ethyl alcohol has a relatively small specific heat.

Also, it is known that the value of the heat transfer coefficient $\alpha$ of the cooling gas-liquid mixture is variable depending on the equation (2):

$$\alpha = f(D_L \cdot R_{G/L}\ T_L\ T_G) \qquad (2)$$

wherein $D_L$ represents a liquid volume density (l/$m^2$ min) of the cooling liquid in the mixture, $R_{G/L}$ represents a ratio in volume of the cooling gas to the cooling liquid in the mixture, $T_L$ represents the temperature (°C.) of the cooling liquid and $T_G$ represents the temperature (°C.) of the cooling gas. It was confirmed by the inventors of the present invention that the heat transfer coefficient $\alpha$ of the cooling gas-liquid mixture is mainly dominated by the value of the liquid volume density $D_L$ of the cooling liquid. Therefore, in order to obtain a desired value of the heat transfer coefficient of the cooling gas-liquid mixture, it is important to adjust the liquid volume density of the cooling liquid to a proper value.

In the process of the above-mentioned Japanese patent application publication, a cooling liquid is atomized by using an atomizer, the resultant stream of the atomized cooling liquid is mixed with a cooling gas, and, then, the cooling gas-liquid mixture is transported to a spraying nozzle through a recirculating device and, finally, jetted to the surface of the steel strip. The above-mentioned method for preparing the cooling gas-liquid mixture is referred to as a pre-mixing method, hereinafter.

In the pre-mixing method, if a stream of atomized cooling liquid, for example, atomized water is used in a large liquid volume density of, for example, 100 $l/m^2 \cdot min$ or more, the fine particles of the atomized cooling liquid are aggregated with each other to form large drops while the cooling gas-liquid mixture is transported to the jetting nozzle. Therefore, it is impossible to form a uniform cooling gas-liquid mixture. The pre-mixing method is unsuitable to prepare a cooling gas-liquid mixture having a large liquid volume density of a cooling liquid. In other words, the cooling gas-liquid mixture usable for rapidly cooling the steel strip at a large cooling rate of, for example, 200° C./sec., cannot be prepared by the conventional pre-mixing method.

The inventors of the present invention found a method capable of preparing the cooling gas-liquid mixture containing the cooling liquid at a very large liquid volume density thereof. That is, the above-mentioned cooling gas-liquid mixture can be prepared by jetting the cooling gas and cooling liquid independently from each other through a separate cooling gas nozzle and a cooling liquid nozzle, in such a manner that the direction of the stream of the jetted cooling gas intersects the stream of the jetted cooling liquid before the jetted cooling gas and liquid streams reach the surface of the steel strip to be cooled. This method of preparing the cooling gas-liquid mixture is referred to as a nozzle mixing method hereinafter.

In the preparation of the cooling gas-liquid mixture by the nozzle mixing method, it is preferable that the flow speed of the jetted cooling gas is maintained at a certain value, for example, 20 m/sec. or more and the volume ratio ($R_{G/L}$) of the cooling gas to the cooling liquid is also maintained at a certain level, for example, of from 50 to 10,000. In this case, the cooling liquid can be atomized and uniformly mixed with the cooling gas, and the fine particles of the atomized cooling liquid in the resultant mixture can be maintained not aggregated even if the cooling liquid is used in a very large liquid volume density. That is, the steel strip can be rapidly cooled at a desired cooling rate by a uniform cooling gas-liquid mixture having a desired heat transfer coefficient.

In a practical cooling procedure using a cooling gas-liquid mixture, it is preferably that the volume ratio ($R_{G/L}$) of the cooling gas to the cooling liquid is in the range of from 50:1, to 10,000:1, more preferably, 100:1 to 5,000:1, under atmospheric pressure. The volume ratio ($R_{G/L}$) of the cooling gas to the cooling liquid should be adjusted so that the jetted mixture does not cause an excessively thick film of the cooling liquid to be formed on the surface of the steel strip and the steel strip to be rolled. Also, excessively large or small volume ratio ($R_{G/L}$) causes the cooling gas-liquid mixture-preparing apparatus including a cooling gas recirculating blower a conduit, a cooling liquid recirculating pump and a pipe to be too large and expensive.

In the cooling procedure for the steel strip, it is important that the cooling procedure is capable of controlling the final temperature of the cooled steel strip. That is, the cooling procedure should be finished when the temperature of the steel strip has reached a desired level. The final temperature can be adjusted by controlling the total amount of the cooling liquid per unit of time jetted to the surface of the steel strip.

FIG. 1 shows the relationship between the total amount (in liters) of the cooling liquid per unit of time (minutes) and the final temperature of the cooled steel strip which had a thickness of 0.7 mm and was moved downward at a speed of 40 m/min along a vertical cooling passage. The total amount of the cooling liquid jetted onto the surface of the steel strip satisfies the relationship (3):

$$F_L = D_L \cdot b \cdot L \quad (3)$$

wherein $F_L$ represents a total amount (l/min) of the cooling liquid, $D_L$ represents the liquid volume density ($l/m^2 \cdot min$) of the cooling liquid, b represents the width (m) of the steel strip and L represents the length of the path of the steel strip in which path the steel strip is cooled by the cooling gas-liquid mixture.

From the relationship (3), it is obvious that the total amount ($F_L$) of the cooling liquid can be adjusted to a desired value by controlling the liquid volume density ($D_L$) or the length (L) of the steel strip path.

For controlling the length (L) of the steel strip path, the final (end point) temperature of the cooled steel strip can be adjusted to a desired value by controlling the number of the streams of the cooling gas-liquid mixture to be jetted to the surface of the steel strip.

In order to easily control the final (end point) temperature of the cooled steel strip, it is important that the steel strip is moved downwardly along a vertical cooling passage, so that the cooling liquid jetted to the surface of the steel strip is allowed to flow down along the surface. Therefore, the cooling area of the steel strip surface on which the cooling liquid flows, can be easily controlled by controlling the locations of the jet streams of the cooling gas-liquid mixture to be applied to the steel strip surface. If the path of the steel strip is horizontal, it is difficult to uniformly cool both the upper and lower surfaces of the steel strip by applying the cooling gas-liquid mixture thereto, because the lower surface of the steel strip cannot hold the cooling liquid thereon while the upper surface can hold the cooling liquid thereon.

Even in the case of the vertical cooling passage, it is necessary to remove the cooling liquid from the steel strip surface at a certain location at which the temperature of steel strip reaches the desired final temperature.

Figure 2:
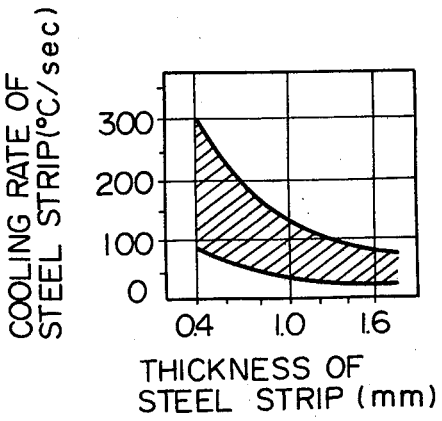
FIG. 2 is a graph showing a relationship between the thickness of a steel strip passing along a vertical cooling passage and the cooling rate of the steel strip when the steel strip is cooled from a temperature of 700° C. to a temperature of 250° C. by jetting a mixture of a cooling gas and a cooling liquid.

The variability of the cooling rate of the steel strip depends on the liquid volume density of the cooling gas-liquid mixture, the specific heat of the cooling liquid and the thickness of the steel strip. For example, in the case where a steel strip having a thickness of from 0.4 to 1.6 mm is cooled from 700° C. to 250° C. by applying a cooling gas-liquid mixture, the variability of the cooling rate of the steel strip is shown in FIG. 2. For example, referring to FIG. 2, the cooling rate of a steel strip having a thickness of 0.7 mm can be altered in a wide range of from about 50° to about 200° C./sec. Within the above-mentioned wide range of the cooling rate, not only an ordinary steel sheet, but also, a high tensile strength steel strip can be cooled in good condition. The lower limit of 50° C./sec. can be attained by using a mixture of the cooling liquid and the cooling gas and the upper limit 200° C./sec. can be attained by using the nozzle mixing method.

In order to obtain a cooled steel strip having a good shape, it is important that in an initial stage of the cooling procedure in which stage the steel strip still has a high temperature and a high deformability, the steel strip is gradually cooled. This gradual cooling for the steel strip is possible by controlling the liquid volume density of the cooling gas-liquid mixture to be applied to the steel strip to a reduced value. Also, the undesirable deformation of the steel strip can be prevented by moving downward the steel strip along its vertical path. This vertical movement of the steel strip is effective for uniformly cooling the steel strip from both the surfaces thereof.

In order to obtain a cooled steel strip having brilliant surfaces thereof, it is important that the cooling procedure is applied to the steel strip in a non-oxidizing atmosphere. This non-oxidizing atmosphere may be provided by using an inert annealing atmospheric gas extracted from the continuous annealing furnace as a cooling gas. This annealing atmospheric gas is non-reactive to the steel strip surface, harmless and cheap. Also, it is necessary that the recirculating line of the cooling gas is completely sealed from the ambient atmosphere. In the case where the extracted annealing atmospheric gas is used as a cooling gas and the cooling gas-recirculating line is sealed from air, even if water is used as a cooling liquid, the amount of the oxide film formed on the surface of the steel strip during the cooling procedure is very small and the oxide film can be easily and completely removed by rinsing the cooled steel strip with an acid aqueous solution after the steel strip is withdrawn from the cooling procedure.

In the process of the above-mentioned Japanese patent application publication, hydrogen gas is used as a cooling gas. However, if water is used as a cooling liquid to be mixed with the hydrogen gas, it is impossible to completely prevent the formation of the oxide film because the concentration of water in the resultant mixture is large. Also, the hydrogen-water mixture has a possiblity of explosion and is expensive. Therefore, it is difficult to practically use a cooling gas consisting of hydrogen gas alone. Usually, the inert gas atmosphere in the continuous annealing furnace for the cold rolled steel strip, consists of nitrogen gas or a mixture of 5% by volume or less of hydrogen gas and the balance consisting of nitrogen gas.

In the cooling process of the present invention, it is essential that each cooling gas-liquid mixture stream applied to each surface of the steel strip which is passing along a vertical cooling path, is provided by jetting the cooling gas and the cooling liquid independently from each other in directions intersecting each other before the jetted cooling gas and liquid streams reach the surface of the steel strip, thereby the cooling gas stream is mixed with the cool liquid stream at the intersecting location before the steel strip surface.

When the steel strip is one annealed in an inert gas atmosphere at an elevated temperature, it is preferable that the cooling gas consists of the inert gas extracted from the annealing process.

The inert gas usable as a cooling gas for the present invention may be selected from nitrogen gas and mixtures of 5% by volume or less of hydrogen gas and the balance consisting of nitrogen gas. Also, the cooling liquid usable for the present invention may comprise water. The water may contain an oxidation-preventing additive.

It is preferable that the cooling gas and the cooling liquid are mixed with each other in a volume ratio which is in the range of from 50:1 to 10000:1, more preferably, from 100:1 to 5000:1, under atmospheric pressure.

In order to aviod undesirable deformation of the steel strip during the cooling procedure, it is preferable that the cooling rate of the steel strip is continuously or intermittently increased by continuously or intermittently increasing the liquid volume density of the cooling liquid in the cooling gas-liquid mixture, while maintaing the amount of the cooling gas in the mixture constant. That is, it is important that in the initial stage of the cooling procedure, the steel strip is gradually cooled by the cooling gas-liquid mixture having a relatively small liquid volume density. Also, in the initial stage of the cooling procedure, it is preferable that the steel strip moves downwardly along a vertical cooling path, so that the cooling liquid applied onto the steel strip surface is allowed to flow down along the steel strip surface concurrently with the downward movement of the steel strip. This concurrent flow down of the cooling liquid is effective for enhancing the cooling effect of the cooling liquid.

Also, the cooling rate of the steel strip can be altered by on-off controlling the application of the cooling gas-liquid mixture streams and by controlling the liquid volume density of the cooling liquid in the mixture streams. In order to increase the cooling rate of the steel strip, it is preferable that the liquid volume density of a cooling gas-liquid steam density applied at a location in the vertical cooling path of the steel strip is controlled so as to be larger than that at another location located upstream from the above-mentioned location.

Furthermore, in order to strictly control the cooling rate of the steel strip, it is preferable that the cooling liquid remaining on the steel strip surface is removed from the steel strip surface at a location in the vertical cooling path before a next cooling gas-liquid mixture stream is applied onto the steel strip surface at another location located downstream from the above-mentioned location.

Moreover, it is preferable that in the final stage of the cooling procedure, the remaining cooling liquid on the steel strip surface is removed therefrom when the temperature of the steel strip has reached a desired final temperature thereof. This is effective for preventing overcooling the steel strip.

The above-mentioned cooling process for the cold rolled steel strip can be carried out by using the apparatus of the present invention.

Figure 3:
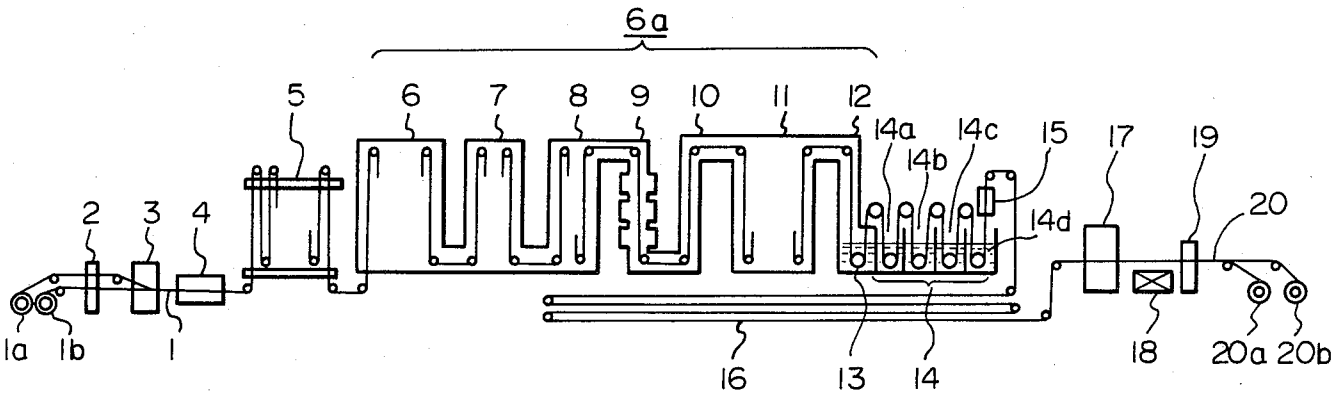
FIG. 3 is an explanatory diagram of an embodiment of a continuous annealing-cooling-overaging-temper rolling apparatus containing an embodiment of the cooling apparatus of the present invention.

FIG. 3 shows an explanatory diagram of an embodiment of the continuous annealing-cooling-overaging-temper rolling apparatus containing an embodiment of the cooling apparatus of the present invention. Referring to FIG. 3, a steel strip 1 is unwound from a coil 1*a* or 1*b*, and a defective portion of the steel strip 1 is removed by an entry shearing machine 2. The remaining pieces of the steel strip are welded to each other by using a welder 3. The welded steel strip is pickled in a pickling zone 4, and introduced into an inlet looper 5, and then, into an annealing furnace sections 6*a* being provided with a heating chamber 6, a temperature-holding chamber 7 and a first gradual cooling chamber 8. In the heating chamber 6, the steel strip 1 is heated to a predetermined annealing temperature of directly heating the steel strip with a burner flame or by emitting radiant heat from a radiant tube to the steel strip. The steel strip 1 is held at the predetermined annealing temperature constant in the temperature-holding chamber 7. In this chamber 7, the heating operation is carried out by using a heat radiant tube or electric heater (not indicated in FIG. 3). Next, the steel strip 1 is introduced into the first gradual cooling chamber 8 in which the steel strip 1 is gradually and uniformly cooled to a predetermined temperature. In this first gradual cooling chamber 8, the cooling operation may be carried out by using a gas jet cooler (not shown in FIG. 3). The cooling of the steel strip may be naturally carried out without using any cooling means. Also, the first gradual cooling chamber 8 may be omitted from the annealing furnace 6*a*. The combination of the temperature-holding chamber 7 and the first gradual cooling chamber 8 is referred to as a uniform heating zone hereinafter.

The exit of the uniform heating zone of the annealing furnace is connected to an entrance of a rapid cooling chamber 9 in which the steel strip is cooled to a predetermined temperature by using a plurality of cooling gas-liquid mixture streams, while controlling the cooling rate of the steel strip and the final temperature of the cooled steel strip.

Next, the cooled steel strip is introduced into a drying chamber 10 so as to completly dry the steel strip. The combination of the cooling chamber 9 and the drying chamber 10 may be referred to as a cooling zone. The dried steel strip is introduced into an overaging chamber 11 and, then, into a second gradual cooling chamber 12 having, for example, a gas jet cooler (not shown in FIG. 3). The cooled steel strip is cooled with water in a water-cooling vessel 13. The combination of the second gradual cooling chamber 12 and the water-cooling vessel 13 may be referred to as a final cooling zone which is used for cooling the steel strip to a certain temperature suitable for post-treating the steel strip.

The cooled steel strip is post-treated in a post-treating apparatus 14 which includes an acid-pickling vessel 14*a*, first water-rinsing vessel 14*b*, an electrolytical treating vessel 14*c* and a second water-rinsing vessel 14*d*.

In this post-treating apparatus 14, the oxide film formed on the steel strip surface during the rapid cooling procedure is removed and the steel strip is cooled to a certain temperature suitable for the temper rolling procedure. The post-treating apparatus 14 should not be located just upstream from the overaging chamber 11, because the post treatment causes the temperature of the steel strip to be much lower than the overaging temperature of the steel strip. The post-treating apparatus 14 may be located just downstream from the delivery looper. However, this location of the post treating apparatus 14 is disadvantageous in that since the moving speed of the steel strip after the delivery looper 16 is frequently varied, it is impossible to post-treat the steel strip at a constant speed.

The post-treated steel strip is dried in a dryer 15. The combination of the post-treating apparatus 14 and the dryer 15 may be referred to as an post-treating section.

Therefore, the steel strip is introduced into an delivery looper 16, and then, temper rolled by a temper rolling mill 17. The temper rolled steel strip is inspected on an inspecting table 18, and, if necessary, a defective portion of the steel strip is removed by a shearing machine 19. The resultant steel strip 20 is wound into a coil 20*a* or 20*b*.

In the apparatus as shown in FIG. 3, in the entry looper 5, heating chamber 6, temperature-holding chamber 7, first gradual cooling chamber 8, rapid cooling chamber 9, drying chamber 10, overaging chamber 11 and second gradual cooling chamber 12, the steel strip moves mainly along vertical moving paths. Therefore, the type of the apparatus as indicated in FIG. 3 is referred to as a vertical type apparatus. This type of apparatus can treat the steel strip at a high speed and has a large capacity, in spite of the fact that the length of the apparatus is relatively small. However, in a horizonal type apparatus in which the steel strip moves mainly along numerous horizontal paths, the length of the apparatus is too large. Therefore, the horizonal type of apparatus cannot be used practically in the steel industry.

The apparatus as indicated in FIG. 3 includes the overaging chamber 11, the temper rolling mill 17 and the delivery looper 16 which has a capacity of containing a certain amount of the steel strip by which the necessary time period for changing the roll in the temper rolling mill 17, is compensated. Therefore, this type of apparatus can be used for the production of not only high strength steel strip (including dual-phase structure type), but also, ordinary cold rolled steel sheet (which is suitable for a drawing pocess). The overaging chamber 11, the delivery looper 16 and the temper rolling mill 17 may be omitted from the apparatus indicated in FIG. 3. This type of apparatus can be used only for producing a high strength steel strip.

In the apparatus indicated in FIG. 3, the first gradual cooling chamber 8 is located just upstream from the rapid cooling chamber 9. This first gradual cooling chamber 8 is useful for cooling the steel strip to a predetermined temperature from which the rapid cooling procedure is started at a predetermined cooling rate. Also, the first gradual cooling operation is sometimes necessary in view of metallurgy and sometimes important to prevent the undesirable deformation of the steel strip.

Figure 4:
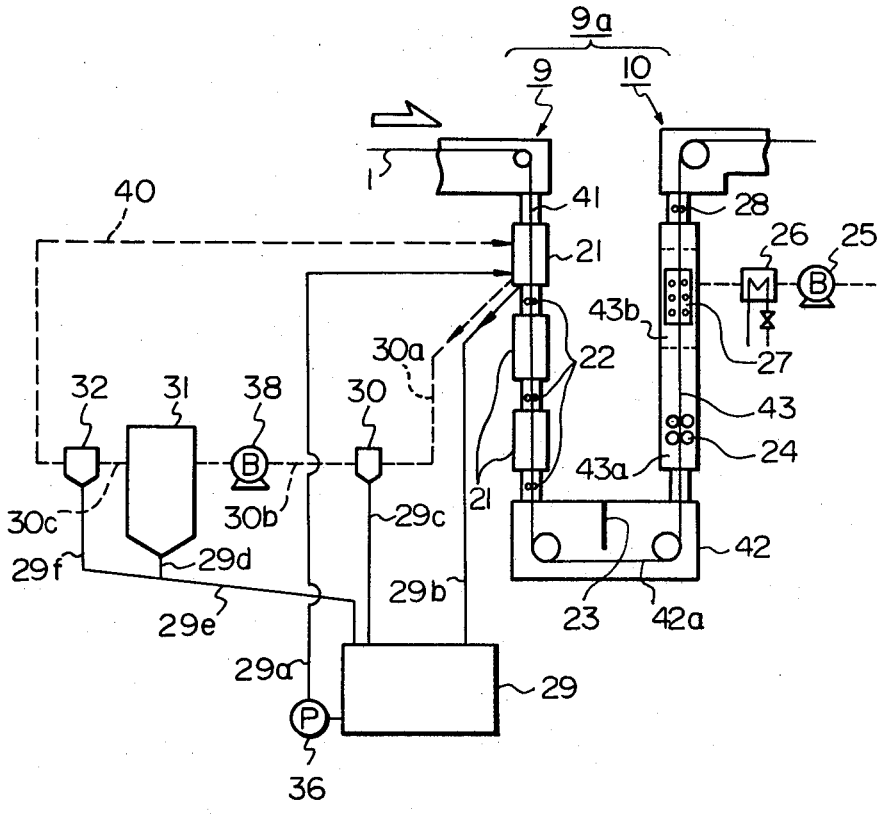
FIG. 4 is an explanatory diagram showing an embodiment of the cooling apparatus of the present invention.

FIG. 4 shows an explanatory diagram of an embodiment of the cooling apparatus of the present invention. Referring to FIG. 4, a cooling apparatus 9*a* is composed of a vertical cooling chamber 9, a vertical drying chamber 10 and a horizonal chamber 42 located between the cooling chamber 9 and the drying chamber 10. In the cooling chamber 9, a steel strip moves along a vertical downward cooling path 41. Also, in the horizontal chamber 42, the steel strip moves along a horizontal path 42*a*. Furthermore, in the drying chamber 10, the steel strip moves along a vertical upward drying path 43.

In the cooling chamber 9, a plurality of cooling chambers 21 are located around the vertical downward cooling path 41. A pair of squeezing rolls 22 are located just downstream from each cooling chambers 21.

The cooling box 21 contains therein at least one pair of means for jetting a cooling gas and a cooling liquid toward each surface of the steel strip and mixing the jetted cooling gas and liquid with each other.

The squeezing rolls 22 are used to remove the cooling liquid from the steel strip surface. The horizontal chamber 42 is provided with a partition plate 23 projecting downward from the center portion of the ceiling of the horizontal chamber.

When the steel strip is air dried in the drying chamber, it is necessary to air-tightly separate the cooling chamber 9 from the drying chamber 10. In this case, a sealing liquid is introduced into the horizontal chamber 42 so as to make the surface level of the liquid higher than the lower end of the partition plate 23. By the partition plate and the sealing liquid in the horizonal chamber 42, the cooling chamber 9 is completely separated from the drying chamber 10.

Two pairs of wringer rolls 24 are located in the entrance portion of the drying chamber 10. The wringer rolls 24 are used to remove the sealing liquid from the steel strip surface. In the middle portion of the drying chamber 10, a dryer header 27 is located. The dryer header 27 is connected to a drying gas supply source (not shown in FIG. 4) through a blower 25 and a steam heater 26. The drying gas, for example, air is blown by means of the blower 25 into the steam heater 26 and heated to a desired temperature, if necessary. The heated drying gas is blown onto each surface of the steel strip upwardly moving along the vertical path 43. A pair of sealing rolls 28 are located in the exit portion of the drying chamber.

In the cooling chamber 9, a cooling liquid is transported from a cooling liquid recirculation tank 29 into each cooling box 21 through a transporting conduit **29*a* by means of a pump 36. Also, a cooling gas is transported into each cooling box 21 through a cooling gas transporting line 40 by means of a cooling gas blower 38. In each cooling box 21**, the cooling gas and the cooling liquid are separately jetted and, then, mixed with each other, and the resultant cooling gas-liquid mixture is applied onto each surface of the steel strip.

Thereafter, a portion of the cooling liquid which has been naturally separated from the cooling gas in the cooling box 21, is withdrawn from the cooling box 21 and conveyed into the cooling liquid recirculation tank 29 through a conduit **29*b*. The cooling gas-liquid mixture used in the cooling box 21 is also withdrawn from the cooling box 21 into a first gas-liquid separator 30 through a conduit 30*a*. The separated liquid is recycled from the first separator 30 to the cooling liquid recirculation tank 29 through a conduit 29*c*. The remaining gas is transported from the first separator 30 to a gas cooler 31 through a conduit 30*b* by means of the blower 38. In this gas cooler 31, a liquid vapour in the gas is condensed into a liquid. The resultant liquid is recycled into the cooling liquid recirculation tank 29 through conduits 29*d* and 29*e*. Thereafter, the remaining gas is conveyed from the gas cooler 31 to a second gas-liquid separator 32 through a conduit 30*c*. The separated liquid in the second separator 32 is recycled therefrom into the cooling liquid recirculation tank 29 through a conduit 29*f* and the conduit 29*e*. The remaining cooling gas which is free from the cooling liquid is transported into each cooling box through the line 40. The cooling gas may be cooled to a predetermined temperature by the gas cooler 31 before being transported into each cooling chamber 21, if necessary. Also, the cooling liquid may be cooled to a predetermined temperature in the recirculation tank 29**.

By using the cooling gas-liquid separating and recycling system as indicated in FIG. 4, the volume ratio of the cooling gas to the cooling liquid, the liquid volume density of the cooling liquid and the temperatures of the cooling gas and liquid can be strictly controlled.

The cooling chamber can be on-off controlled independently from each other.

Also, it is possible to independently control the liquid volume densities of the cooling gas-liquid mixtures in a plurality of the cooling boxes.

Furthermore, a pair of the squeezing rolls 22 are provided just downstream from each cooling box so as to remove the cooling liquid from the steel strip surface. If no squeezing rolls are provided, the cooling liquid jetted from the nozzle in a downstream cooling box is allowed to flow down along the steel strip surface even after the temperature of the steel strip has reached the desired final temperature. The flow down of the cooling liquid causes the steel strip to be overcooled.

In FIG. 4, the cooling chamber 9 is provided with three cooling boxes 21. However, the number of cooling boxes 21 is not limited to 3. That is, the number of cooling boxes 21 may be 1, 2 or 3 or more.

Since the rapid cooling chamber 9 is separated from the ambient air, it is possible to protect the steel strip surface from undesirable oxidation thereof.

In the rapid cooling apparatus as shown in FIGS. 3 and 4, the cooling chamber is provided with a single vertical cooling path for the steel strip. However, in the rapid cooling apparatus of the present invention, the cooling chamber may contain two or more vertical cooling paths for the steel strip. In this case, it is preferable that in at least the initial vertical cooling path, the steel strip moves downwardly. If in the initial vertical path, the steel strip moves upwardly, a portion of the cooling liquid applied to the surface of the upper portion of the steel strip in the vertical path, sometimes unevenly flows down onto the surface of the lower portion of the steel strip. Since the temperature of the lower portion of the steel strip is higher than that of the upper portion of the steel strip, the uneven downward flow of the cooling liquid causes the lower portion of the steel strip to be unevenly cooled and, therefore, to be undesirably deformed. Also, the downward flow of the cooling liquid on the surface of the lower portion of the steel strip causes the control of the cooling rate of the steel strip in the initial stage of the cooling procedure to become difficult.

Also, it is preferable that the drying chamber contains a vertical drying path along which the steel strip moves upwardly. In this case, as stated before, the atmosphere in the cooling chamber is easily separated from the atmosphere in the drying chamber by means of the horizontal chamber. If in the drying chamber, the steel strip moves downwardly, the cooling liquid remaining on the steel strip surface flows down concurrently with the movement of the steel strip. This downward flow of the cooling liquid sometimes hinders the completion of the drying procedure for the steel strip.

Figure 5:
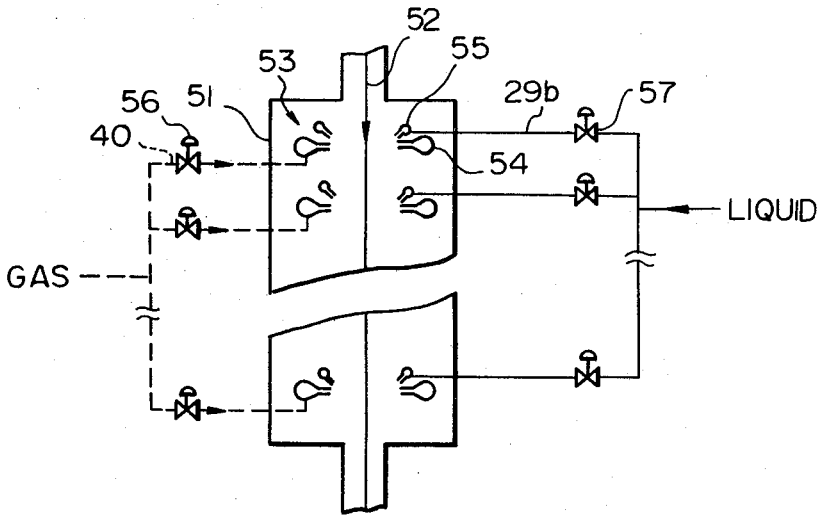
FIG. 5 is an explanatory diagram showing an embodiment of the cooling chamber used in the cooling apparatus of the present invention.

FIG. 5 shows an explanatory diagram of an embodiment of the cooling box usable for the apparatus of the present invention.

Figure 6:
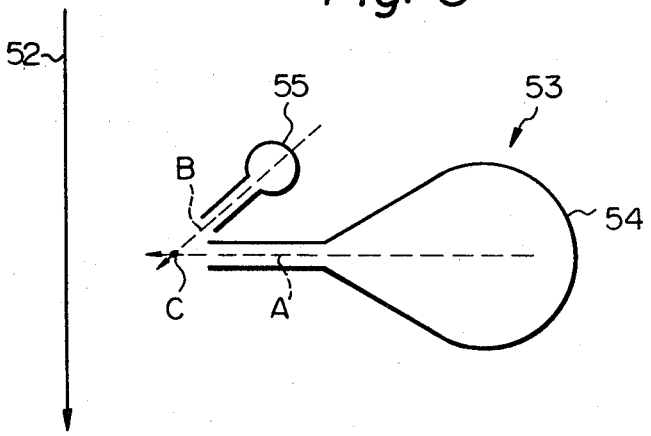
FIG. 6 is an explanatory diagram showing a combination of a cooling gas nozzle and a cooling liquid gas nozzle.

Referring to FIG. 5, a cooling chamber 51 is separated from the ambient air and surrounds a vertical path 52 of the steel strip. The cooling chamber 51 contains therein at least one pair of cooling gas-liquid mixture-forming devices 53 each consisting of a cooling gas nozzle 54 and a cooling liquid nozzle 55. The pair of cooling gas-liquid mixture-forming devices 53 face each other through the vertical path 52 of the steel strip, so as to apply the cooling gas-liquid mixture to each surface of the steel strip in the vertical path 52. That is, as indicated in FIG. 6 the cooling gas nozzle 54 and the cooling liquid nozzle 55 is directed to the vertical path 52 and the direction A of the cooling gas nozzle 54 intersects direction B of the cooling liquid nozzle 55 at a location C located before the vertical path 52 of the steel strip. The stream of the cooling gas jetted from the cooling gas nozzle 54 encounters with and is mixed with the stream of the cooling liquid jetted from the cooling liquid nozzle 55 at the location C. The resultant cooling gas-liquid mixture stream is applied onto the surface of the steel strip moving along the vertical path 52.

It is preferable that the direction A of cooling gas nozzle 54 is at right angles to the vertical path 52 of the steel strip. Also, it is preferable that the angle formed between the directions A and B of the cooling gas nozzle 54 and the cooling liquid nozzle 55 is an acute angle.

As indicated in FIGS. 3 and 4, the cooling apparatus of the present invention may be provided with two or more cooling boxes. In this case, the cooling boxes are arranged successively along the vertical path of the steel strip.

Each cooling gas nozzle is connected to a cooling gas supply line 40 which is connected to a cooling gas recycling system as indicated in FIG. 4. Also, each cooling liquid nozzle is connected to a cooling liquid supply conduit **29*b* which is connected to a cooling liquid recycling system as indicated in FIG. 4. Each cooling gas supply line 40 and each cooling liquid supply conduit 29*b* may be provided with a valve 56 and a valve 57, respectively. The valve 56 can on-off control the cooling gas nozzle 54 and also control the flow rate of the cooling gas to be jetted from the cooling gas nozzle 54. Also, the valve 57 can on-off control the cooling liquid nozzle 55 and, also, control the flow rate of the cooling liquid to be jetted from the cooling liquid nozzle 55. The on-off control of the cooling gas nozzle 54 and/or the cooling liquid nozzle 55 may be effected by valves other than valves 56 and 57, respectively. In this case, the valves 56 and 57** are used for controlling only the flow rates of the cooling gas and the cooling liquid, respectively.

When the process and apparatus of the present invention is used for cooling the annealed steel strip, the cooling procedure is started at a temperature of from 600° C. to the annealing temperature at which the steel strip is held in the temperature-holding chamber. When the cooled steel strip is subjected to an overaging procedure, the cooling procedure is controlled so as to stop it when the temperature of the steel strip has reached a predetermined final temperature in the range of from 350° to 550° C. Also, no overaging procedure is applied to the cooled steel strip, the cooling procedure is controlled so as to finish it after the temperature of the steel strip has reached a temperature of 250° C. or less.

In the case where the cooled steel strip is subjected to an overaging procedure, the steel strip having a temperature of from 350° to 550° C. may be introduced from the cooling chamber into the drying chamber. In this case, since the cooling liquid remaining on the steel strip surface can be evaporated by the heat held by the steel strip itself without heating it from the outside, the drying procedure can be carried out by using a drying chamber as indicated in FIG. 7.

Figure 7:
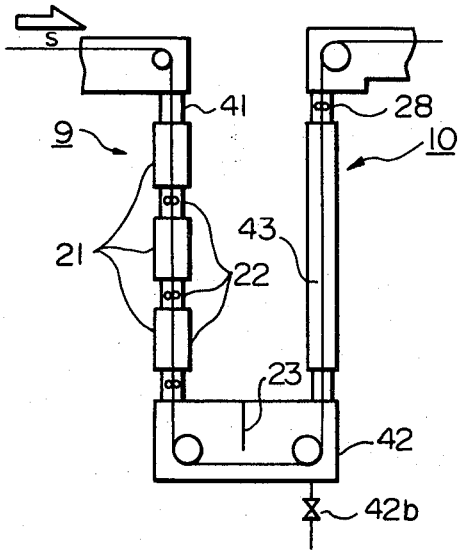
FIG. 7 is an explanatory diagram showing another embodiment of the cooling apparatus of the present invention.

Referring to FIG. 7, the horizontal chamber 42 contains no liquid. That is, the liquid can be removed by opening a valve **42*b*. The drying chamber 10 may be provided with no squeezing rolls and heating means for the steel strip. The drying chamber 10 is a closed chamber and separated from the ambient air. Therefore, the steel strip surface can be protected from oxidation thereof by the ambient air. The vapor of the cooling liquid generated in the drying chamber can be withdrawn by means of the blower 38 in the cooling gas recycling system as indicated in FIG. 4, through the horizontal chamber 42. The vapor is liquefied and separated from the cooling gas and, then, transported into the cooling liquid recirculation tank 29 as indicated in FIG. 4**.

In the case where no overaging procedure is applied to the cooled steel strip, the final temperature of the cooled steel strip 250° C. or less which is not high enough for completely drying the remaining cooling liquid by the heat held by the cooled steel strip itself. Therefore, it is necessary to heat the steel strip by blowing a drying gas to the steel strip. In this case, the drying procedure can be effected by using the drying chamber as indicated in FIG. 8.

Figure 8:
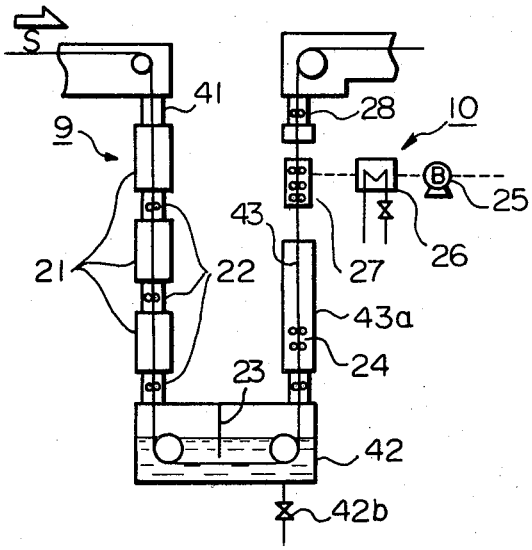
FIG. 8 is an explanatory diagram showing still another embodiment of the cooling apparatus of the present invention.

Referring to FIG. 8, the cooling chamber 9 is separated from the drying chamber 10 by filling the horizontal chamber 42 with a liquid. The liquid remaining on the steel strip surface, which has passed through the horizontal chamber 42, is removed by using pairs of wringer rolls 24. The lower end of the vertical chamber **43*a* is open to the ambient air. After passing through the vertical chamber 43*a*, the surface of the steel strip is dried by blowing thereonto a drying gas stream which has been generated by means of the blower 25 and heated to a desired elevated temperature by means of the heater 26**. This drying operation is conducted in the ambient air.

Referring to FIG. 4, the drying chamber may be provided with a portion **43*b* thereof which is capable of opening and closing to the ambient air and which contains therein the dryer head 27**.

When the dryer chamber 10 is used for drying a cooled steel strip having a temperature of from 350° to 550° C., the horizontal chamber 43 contains no liquid, the wringer rolls 24 are released from the steel strip, the portion **43*b* is air-tightly closed, no drying gas in blown through the dryer head 27 and the sealing rolls 28 is used to seal the drying chamber 10. In this case, the function of the drying chamber 10 is the same as that indicated in FIG. 7**.

Also, when the dryer chamber 10 is used for drying a cooled steel strip having a temperature of 250° C. or less, the horizontal chamber 42 is charged with liquid to separate the drying chamber 10 from the cooling chamber 9, the wringer rolls 24 are used to remove the remaining liquid from the steel strip surface, the portion **43*b* is opened and the drying gas is blown onto the steel strip surface through the dryer head 27. In this case, the function of the drying chamber is the same as that indicated in FIG. 8**.

That is, the process and apparatus of the present invention are useful for producing not only ordinary cold rolled steel sheets which have been overaged after the rapid cooling procedure, but also, high strength steel strips, especially, of the dual phase type, which have been not overaged.

Figure 9:
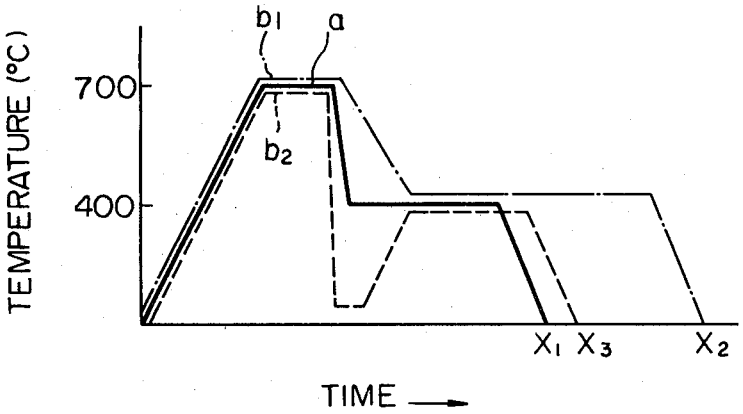
FIG. 9 is a graph showing a relationship between a process time and the temperature of a steel strip in each annealing-cooling-overaging process including the cooling process of the present invention and two different conventional annealing-cooling-overaging processes each including a cooling process different from the cooling process of the present invention, the above-mentioned processes being carried out for producing an ordinary steel sheet.

Referring to FIG. 9, line a indicates a relationship between a time lapse in an annealing-cooling-overaging process which included the cooling process of the present invention and which was applied to a cold rolled capped steel sheet having a thickness of 0.7 mm, and a temperature of the steel sheet. In the process, the steel sheet is heated to an annealing temperature of about 700° C., and held at this temperature for a necessary period of time. Thereafter, the annealed steel sheet was rapidly cooled to a temperature of about 400° C. at an average cooling rate of about 100° C./sec. in accordance with the cooling process of the present invention. The cooling procedure was stopped at a temperature of about 400° C. The cooled steel sheet was overaged at about 400° C. for a necessary time of about 1.5 minutes and, then cooled to the ambinent temperature in accordance with the usual method. The necessary time for completing the process indicated by the line a is indicated by $X_1$.

In FIG. 9, line $b_1$ indicates another annealing-cooling-overaging process which contained a conventional type of cooling process and which was applied to the same type of steel sheet as that used in the process indicated by the line a. In the conventional cooling process, the annealed steel sheet was cooled by jetting a cooling gas to the steel sheet. The cooling was carried out at an average cooling rate of about 10° C./sec. The overaging process was carried out for about 3 minutes and finished at a time $X_2$. From FIG. 9, it is clear that the time $X_2$ is remarkably larger than the time $X_1$.

In FIG. 9, line $b_2$ indicates still another conventional annealing-cooling-overaging process. In this process, the annealed steel sheet, which was of the same type as that used in the process indicated by line a, was rapidly cooled at a cooling rate of about 1000° C./sec. or more by a water-quenching method. In this case, since the final temperature of the cooled steel strip was extremely lower than the overaging temperature of about 400° C., it was necessary to re-heat the cooled steel strip up to about 400° C. The overaging process was carried out for a necessary time of about 1 minute and completed at a time $X_3$. From FIG. 9, it is evident that the time $X_1$ is shorter than the time $X_3$.

It was found by the inventors of the present invention that the apparatus for carrying out the process indicated by the line $b_1$ is necessary to have a length thereof 1.32 times that indicated by the line a. Also, the apparatus for effecting the process indicated by the line $b_2$ has a length thereof of 1.02 times that indicated by the line a. Also, it was found that while the cost of the process indicated by the line $b_1$ was about the same as that indicated by the line a the cost of the process indicated by the line $b_2$ was 1.35 times that indicated by the line a, because the process of line $b_2$ contains the re-heating procedure for the cooled steel sheet.

Furthermore, it was found that while the products of the processes indicated by the lines a and $b_1$ exhibited a satisfactory ductility, the product from the process indicated by the line $b_2$ exhibited a poor ductility and the metallurgical structure of the product contained fine carbides produced by the re-heating procedure.

Figure 10:
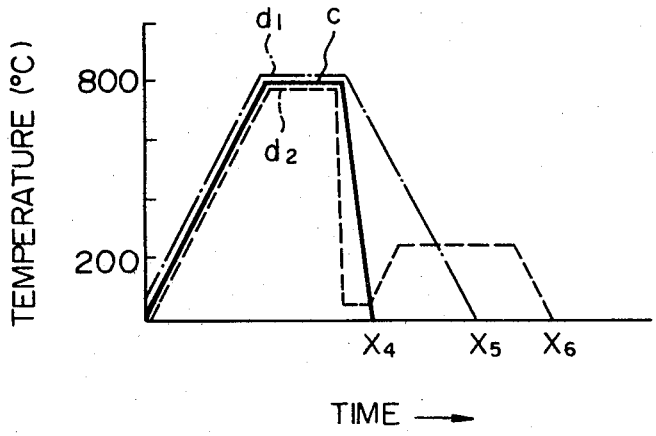
FIG. 10 is a graph showing a relationship between a process time and the temperature of a steel strip in each annealing-cooling process including the cooling process of the present invention and two different conventional annealing-cooling process each including a cooling process different from the cooling process of the present invention, the above-mentioned processes all being carried out for producing a two phase structure type high tensile strength steel strip.

Referring to FIG. 10, lines c, $d_1$ and $d_2$ respectively indicate a process for producing a high tensile strength steel strip by annealing and cooling it. In line c, a steel strip containing 1.5% by weight of manganese was annealed at about 800° C. and, then, rapidly cooled at an average cooling rate of about 100° C./sec. by the process of the present invention. This process was completed at a time $X_4$. In the process indicated by the line $d_1$, the annealed steel strip which contained 2.0% by weight of manganese, was cooled by jetting a cooling gas to the steel strip. The cooling procedure was carried out gradually at a cooling rate of about 10° C./sec. and completed at a time $X_5$. In this case, the cost of the process was about 1.27 times that indicated by the line c, while the product of the process indicated by the line $d_1$ exhibited a satisfactory ductility and yield ratio which were similar to those of the product of the process indicated by the line c.

In the process indicated by the line $d_2$ in FIG. 10, the annealed steel strip which contained 1.5% by weight of manganese, was rapidly cooled at a cooling rate of about 1000° C./sec. or more by the conventional water-quenching method. In this case, in order to obtain a satisfactory tensile strength and total elongation it was necessary to re-heat the cooled steel strip to about 250° C. and to age it at this temperature for a necessary time of about 1 minute. This aging procedure was finished at a time $X_6$.

FIG. 10 clearly indicates that the time $X_4$ is shorter than $X_5$ and $X_6$.

In the process indicated by the line $d_2$, the cost of the process was about 1.03 times that of the process indicated by the line c. Also, it was found that the product of the process indicated by the line $d_2$ exhibited a poor ductility and an undesirably high yield ratio, and contained therein undesirable fine carbides which were produced by the re-heating procedure.

SPECIFIC EXAMPLES OF THE INVENTION

The following specific examples are presented for the purpose of clarifying the present invention. However, it should be understood that these are intended only to be examples of the present invention and are not intended to limit the scope of the present invention in any way.

EXAMPLE 1 AND COMPARATIVE EXAMPLES 1 AND 2

In each of the Example 1 and Comparative Examples 1 and 2, a cold rolled steel strip usable for a drawing process was produced from a capped steel containing 0.057% by weight of carbon, 0.01% by weight of silicon, 0.23% by weight of manganese, 0.016% by weight of phosphorus, 0.014% by weight of sulfur, 0.001% by weight of aluminium and 0.0015% by weight of nitrogen.

The capped steel material was hot rolled to a thickness of 2.7 mm, wound at a temperature of 680° C., pickled with an acid aqueous solution and, then, cold rolled to a thickness of 0.8 mm.

In Example 1, the cold rolled steel strip was continuously heated to a temperature of 702° C. and held at this temperature for 40 seconds in an annealing furnace. The resultant annealed steel strip was rapidly cooled from a temperature of 687° C. to 400° C. at an average cooling rate of about 100° C./sec. for 3 seconds. In this rapid cooling procedure, the cooling apparatus as indicated in FIG. 4 was used. The cooling apparatus had a cooling chamber containing a vertical downward cooling path of the steel strip and being provided with three cooling boxes. Each cooling box was provided with 5 pairs of cooling gas-liquid mixture jetting devices. In each cooling gas-liquid mixture jetting device, a cooling gas nozzle was directed to the vertical path at right angles thereto, and, a cooling liquid nozzle was also directed to the vertical path at an acute angle of 30 degree formed between the directions of the cooling gas and liquid nozzles. The directions intersected 10 cm before the vertical path.

A portion of the atmospheric gas consisting of 4% of hydrogen and the balance consisting of nitrogen in the annealing furnace was extracted and fed to the cooling gas nozzle. The cooling gas nozzle had a slit having a length of 1.8 m and a width of 1 cm. The cooling gas was jetted through the slit at a flow rate of 25 m/sec.

The cooling liquid consisted of water having a temperature of 60° C. The cooling liquid nozzle had a slit having a length of 1.7 m and a width of 5 mm. The cooling liquid was jetted through the slit at a flow rate of 36 l/min and at a liquid volume density of 30 $l/m^2 \cdot min$.

When the steel strip passed through the rapid cooling procedure, the steel strip had a temperature of about 405° C. This steel strip was directly subjected to an overaging procedure at a temperature of about 400° C. for about 90 seconds.

The resultant steel strip exhibited a yield strength of 21.2 $kg/mm^2$, a tensile strength of 33.1 $kg/mm^2$ and an total elongation of 43.5% and had satisfactory smooth, flat and brilliant surfaces.

In Comparative Example 1, the same type of cold rolled steel strip as that mentioned in Example 1 was continuously heated to 705° C., held at this temperature for about 40 seconds in an annealing furnace, and then, gradually cooled by jetting thereto a cooling gas consisting of 4% of hydrogen and the balance consisting of nitrogen by using a conventional gas jet type cooling apparatus. In this cooling procedure, the steel strip was cooled from 705° C. to 410° C. at a cooling rate of approximately 10° C./sec. over a cooling time period of about 30 seconds. When the cooling procedure was finished, the cooled steel strip had a temperature of 410° C. The cooled steel strip was directly subjected to an overaging procedure at a temperature of about 400° C. for about 180 seconds.

The resultant steel strip exhibited a yield strength of 21.7 $kg/mm^2$, a tensile strength of 33.3 $kg/mm^2$ and a total elongation of 43%, and had satisfactory smooth, flat and brilliant surfaces.

In Comparative Example 2, the same type of cold rolled steel strip as that mentioned in Example 1 was continuously heated to a temperature of 703° C. and held at this temperature for about 40 seconds in an annealing furnace. The annealed steel strip was rapidly cooled from a temperature of 560° C. to a temperature of 90° C. at a cooling rate of about 1000° C./sec. by a conventional water-quenching type cooling method. As a result of the cooling procedure, the cooled steel strip had a temperature of 50° C. Next, the steel strip was re-heated to a temperature of about 400° C. and, finally, overaged at this temperature for about 60 seconds.

The resultant steel strip exhibited a yield strength of 23.1 $kg/mm^2$, a tensile strength of 33.5 $kg/mm^2$ and an total elongation of 41.5%. It was found that the side edge portions of the resultant steel strip were partially, discontinuously stretched and, therefore, corrugated while the surfaces of the steel strip were satisfactorily brilliant.

From the above-mentioned Example 1 and Comparative Examples 1 and 2, it is concluded that in Example 1 in accordance with the process of the present invention, the annealed steel strip could be rapidly cooled at a satisfactory cooling rate and the cooling procedure could be terminated at an approximately desired temperature of the steel strip. Therefore, no re-heating procedure was necessary before applying the overaging procedure to the steel strip. Also, the resultant product exhibited satisfactory mechanical properties and appearance.

However, in Comparative Example 1, the cooling rate was too small. This caused the necessary cooling time to be too long and also, the necessary overaging time to be too long (180 seconds which was twice that of Example 1). Therefore, the investment of the process mentioned in Comparative Example 1 is higher than that of Example 1.

Also, in Comparative Example 2, since the cooled steel strip had a excessively low temperature, it was necessary to re-heat it to a necessary temperature for the overaging procedure. This caused the process used in Comparison Example 2 to be more costly than that in Example 1. Also, the resultant product of Comparative Example 2 exhibited poorer ductility than that of Example 1, and had unsatisfactory side edge portions.

EXAMPLE 2 AND COMPARATIVE EXAMPLES 3 AND 4

In Example 2 and Comparative Examples 3 and 4, a highly workable high tensile strength cold rolled steel strip having a dual phase mixture structure and a tensile strength of about 60 $kg/mm^2$, was produced from a manganese steel material containing 0.083% by weight of carbon, 0.63% by weight of silicon, 0.016% by weight of phosphorus, 0.006% by weight of sulfur, 0.055% by weight of aluminium, 0.0048% by weight of nitrogen and 1.58% by weight (in Example 2 and Comparative Example 4) or 2.01% by weight (in Comparative Example 3) of manganese. Among the above mentioned three Example 2 and Comparative Examples 3 and 4, the content of manganese in the steel materials used was changed so that each resultant product exhibits about the same tensile strength, that is, approximately 60 $kg/mm^2$.

The steel material was hot rolled to a thickness of 2.3 mm at a finishing temperature of 880° C. and wound at a temperature of 600° C. The wound steel material was pickled with an acid aqueous solution and, then, cold rolled to provide a cold rolled steel strip having a thickness of 0.7 mm.

In Example 2, the cold rolled steel strip was continuously heated to a temperature of 751° C. and held at this temperature for about 40 seconds in an annealing temperature. Thereafter, the annealed steel strip was rapidly cooled at a cooling rate of about 200° C./sec. from 711° C. to 250° C. for about 3 seconds. In the cooling procedure the same cooling apparatus as that mentioned in Example 1 was used. However, the cooling gas consisting of the atmospheric gas extracted from the annealing furnace and the cooling liquid, water, were jetted at a liquid volume density of 60 $l/m^2 \cdot min$. The cooling procedure resulted in a temperature of 255° C. of the cooled steel strip.

The resultant steel strip exhibited a tensile strength of 62.1 $kg/mm^2$, a total elongation of 34% and a yield ratio of 53% and had flat, smooth and brilliant surfaces thereof.

In Comparative Example 3, the cold rolled steel strip containing 2.01% by weight of manganese, was heated to 754° C. and held at this temperature for about 40 seconds in continuous annealing furnace. The annealed steel strip was cooled from 754° to 250° C. at a cooling rate of approximately 10° C./sec. over a time period of about 50 seconds by the same conventional gas jet cooling method as that described in Comparative Example 1. This cooling procedure resulted in a temperature of 257° C. of the cooled steel strip.

The resulting steel strip exhibited a satisfactory tensile strength of 61.8 kg/mm$^2$ and a total elongation of 36% and an unsatisfactorily large yield ratio of 65% and had satisfactorily flat, smooth and brilliant surfaces.

In Comparative Example 4, the same type of cold rolled steel strip as that described in Example 2 were heated to a temperature of 752° C. and held at this temperature for about 40 seconds in a continuous annealing furnace.

The annealed steel strip was rapidly cooled from 463° C. to 90° C. at a cooling rate of approximately 1000° C./sec. by the same conventional water-quenching type cooling method as that described in Comparative Example 2. The final temperature of the cooled steel strip was 60° C. Due to the excessively large fast cooling rate, it was necessary in order to obtain a steel strip having the desired tensile strength of about 60 kg/mm$^2$, and total elongation of 50% that the cooled steel strip was re-heated to a temperature of 250° C. and overaged at this temperature for about 60 seconds.

The resultant steel strip exhibited a satisfactory tensile strength of 62.5 kg/mm$^2$ and an unsatisfactorily small total elongation of 25% and a large yield ratio of 71%. Also, the steel strip had brilliant surfaces thereof while the side edge portions of the steel strip were partially elongated defectively and, therefore, corrugated.

From the comparison of results of Example 2 with those of Comparative Example 4, it is clear that the annealed manganese steel strip could be rapidly cooled at a satisfactorily fast cooling rate and the cooling procedure could be terminated at a desired final temperature of the steel strip. Therefore, no re-heating procedure and overaging procedure were necessary for the cooled steel strip. This feature caused the productivity of the steel strip by using the process of the present invention to be excellent. Also, the length of the annealing-cooling apparatus containing the cooling apparatus of the present invention is relatively short.

Furthermore, from the comparison of Example 2 with Comparative Example 3, it is clear that by using the process and apparatus of the present invention, it became possible to produce a satisfactorily high strength steel strip having an excellent total elongation and yield ratio and a satisfactory dual phase structure, even when the manganese steel material containing a smaller content of manganese than that used in Comparative Example 3, was used.

We claim:

1. A process for continuously cooling a cold-rolled steel strip which has been annealed in an inert gas atmosphere at an elevated temperature, which process comprises the steps of:

(a) moving a cold-rolled steel strip vertically downward along at least one cooling path, (b) bringing a plurality of streams, each stream consisting of a cooling gas and a cooling liquid comprising water, respectively, into contact with each surface of said steel strip in order to cool said steel strip to a predetermined temperature at a predetermined cooling rate, each stream being jetted independently from each other, and in which process, (i) said cooling gas consisting of a cooled inert gas extracted from said annealing process, (ii) said cooling gas and cooling liquid streams being jetted in directions intersecting each other before the jetted cooling gas and liquid streams reach the surface of said steel strip, thus providing a plurality of cooling gas-liquid mixture streams, (iii) said cooling gas and said cooling liquid being mixed with each other in a volume ratio which is in the range of from 100:1 to 5,000:1 under atmospheric pressure, (c) removing the cooling liquid remaining on said steel strip surface from said surface when the temperature of said steel strip has reached the desired final temperature, and (d) moving said cooled strip into a vertically upward drying path to dry said steel strip.

2. A process as claimed in claim 1, wherein said cooling rate is continuously or intermittently increased by continuously or intermittently increasing the liquid volume density of said cooling liquid in said cooling gas-liquid mixture stream, while maintaining the amount of said cooling gas constant.

3. A process as claimed in claim 1, wherein said cooling liquid remaining on said steel strip surface is removed from said steel strip surface before a next cooling gas-liquid mixture stream is applied to said steel strip surface.

4. A process as claimed in claim 1, wherein in the final stage of said cooling procedure, said cooling liquid remaining on said steel strip surface is removed from said steel strip surface when the temperature of said steel strip has reached a desired final temperature.

5. A process as claimed in claim 1, wherein the liquid volume density of said cooling gas-liquid mixture stream supplied at a location in said vertical cooling path is larger than that at another location located upstream from the above-mentioned location.

* * * * *